US009507359B2

(12) United States Patent
Hou

(10) Patent No.: US 9,507,359 B2
(45) Date of Patent: Nov. 29, 2016

(54) POWER SUPPLY CONTROL METHOD AND DEVICE

(71) Applicant: Huawei Technologies Co., Ltd., Shenzhen (CN)

(72) Inventor: Zhaozheng Hou, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 55 days.

(21) Appl. No.: 14/725,060

(22) Filed: May 29, 2015

(65) Prior Publication Data

US 2015/0346751 A1 Dec. 3, 2015

(30) Foreign Application Priority Data

May 30, 2014 (CN) ..... 2014 1 0241174

(51) Int. Cl.
*G05F 1/46* (2006.01)
*G05F 1/625* (2006.01)
*G05F 5/00* (2006.01)

(52) U.S. Cl.
CPC ..... *G05F 1/625* (2013.01); *G05F 5/00* (2013.01)

(58) Field of Classification Search
CPC ..... G05F 1/00; G05F 1/10; G05F 1/46; G05F 1/462; G05F 1/56; G05F 1/565; G05F 1/575; G05F 3/155; G05F 3/158
USPC ..... 323/234, 265, 268, 275
See application file for complete search history.

(56) References Cited

U.S. PATENT DOCUMENTS 4,757,434 A * 7/1988 Kawabata ..... H02M 7/53873 363/132
5,034,872 A * 7/1991 Losic ..... H02P 27/08 318/811
5,198,746 A * 3/1993 Gyugyi ..... H02J 3/1814 307/102
7,902,803 B2 * 3/2011 Peng ..... H02M 3/157 323/283
8,698,469 B1 4/2014 Latham et al.
2003/0030894 A1 * 2/2003 Stentz ..... H01S 3/06754 359/341.41
2003/0052633 A1 * 3/2003 Inagaki ..... H02P 25/098 318/432
2004/0183496 A1 * 9/2004 Yoshimoto ..... H02P 25/024 318/715

(Continued)

FOREIGN PATENT DOCUMENTS

CN 101345528 A 1/2009
CN 103731013 A 4/2014
CN 103762845 A 4/2014

OTHER PUBLICATIONS

Partial English Translation and Abstract of Chinese Patent Application No. CN103731013A, Jun. 11, 2015, 29 pages.

(Continued)

*Primary Examiner* — Adolf Berhane
(74) *Attorney, Agent, or Firm* — Conley Rose, P.C.

(57) ABSTRACT

A power supply control method and device and relates to the field of electronics, and can alleviate impact of a power supply input disturbance on an output voltage. A specific solution is as follows: sampling an input voltage to generate a sampled input voltage; performing anti-steady-state-disturbance processing on the sampled input voltage to generate a feed-forward input voltage; sampling an output voltage to generate a sampled output voltage; and combining the sampled output voltage and the feed-forward input voltage that is output by a feed-forward digital control circuit into a stability voltage. The present invention is applied to power supply control.

12 Claims, 6 Drawing Sheets

(56) References Cited

U.S. PATENT DOCUMENTS

2006/0022655 A1* 2/2006 Nakai ..... H02M 3/1588 323/282
2008/0221710 A1* 9/2008 Brunell ..... G05B 13/042 700/45
2009/0005886 A1* 1/2009 Gao ..... G05B 5/01 700/29
2011/0176337 A1* 7/2011 Young ..... H02M 3/156 363/21.11
2012/0013322 A1* 1/2012 Dearborn ..... H02M 3/156 323/283
2012/0249093 A1* 10/2012 Grbo ..... H02M 3/1588 323/234
2013/0076317 A1 3/2013 Yeh et al.

OTHER PUBLICATIONS

Foreign Communication From a Counterpart Application, Chinese Application No. 201410241174.7, Chinese Office Action dated May 4, 2015, 6 pages.

* cited by examiner

POWER SUPPLY CONTROL METHOD AND DEVICE

CROSS-REFERENCE TO RELATED APPLICATIONS

This application claims priority to Chinese Patent Application No. 201410241174.7, filed on May 30, 2014, which is hereby incorporated by reference in its entirety.

TECHNICAL FIELD

The present invention relates to the field of electronics, and in particular, to a power supply control method and device.

BACKGROUND

Because of being adjustable, a digital power source usually encounters an input disturbance and an output disturbance, and to stabilize an output voltage, this part of disturbance needs to be suppressed, particularly in a case of high fluctuation and a high dynamic load change rate. In the prior art, an input disturbance is generally resolved by using a feed-forward digital control circuit, while a load disturbance is generally resolved by reducing output impedance by adding an output capacity and adding system bandwidth, or by reducing dynamic output impedance by means of non-linear control.

However, in the prior art, in all pure digital feed-forward technologies about digital power sources, an analog to digital converter (ADC) is used to sample an input voltage, and a backchannel control quantity is modulated to control a duty cycle. As a result, a disturbance of a feed-forward channel is directly reflected on the duty cycle, which increases impact of an output disturbance at time of a steady input while improving dynamic input suppression.

SUMMARY

Embodiments of the present invention provide a power supply control method and device that can alleviate impact of a power source input disturbance on an output voltage.

To achieve the foregoing objective, embodiments of the present invention use the following technical solutions:

According to a first aspect, a power supply control loop includes a feed-forward digital control circuit and a feedback digital control circuit, where the feed-forward digital control circuit is configured to sample an input voltage to generate a sampled input voltage, perform anti-steady-state-disturbance processing on the sampled input voltage to generate a feed-forward input voltage, and output the feed-forward input voltage; and the feedback digital control circuit is configured to sample an output voltage to generate a sampled output voltage, and combine the sampled output voltage and the feed-forward input voltage that is output by the feed-forward digital control circuit into a stability voltage.

With reference to the first aspect, in a first possible implementation manner, the feed-forward digital control circuit includes a sampling module, an anti-steady-state-disturbance processing module, a delay module, and a filtering module, where an output end of the sampling module is connected to an input end of the anti-steady-state-disturbance processing module, an output end of the delay module is connected to an input end of the anti-steady-state-disturbance processing module, an output end of the anti-steady-state-disturbance processing module is connected to an input end of the delay module, and the output end of the anti-steady-state-disturbance processing module is connected to an input end of the filtering module; where the sampling module is configured to sample the input voltage, and transmit the sampled input voltage to the anti-steady-state-disturbance processing module; the anti-steady-state-disturbance processing module is configured to receive the sampled input voltage transmitted by the sampling module, receive a previous-moment input voltage transmitted by the delay module, calculate a difference between the sampled input voltage and the previous-moment input voltage, and use a result of the calculating as a reference voltage; output the previous-moment input voltage as the feed-forward input voltage if an absolute value of the reference voltage is less than or equal to a first threshold, where the first threshold is a positive number; calculate a sum of the previous-moment input voltage and a preset step rate, and transmit a result of the calculating as the feed-forward input voltage to the delay module and the filtering module if the absolute value of the reference voltage is greater than the first threshold, and the reference voltage is positive; and calculate a difference of the previous-moment input voltage minus the preset step rate, and transmit a result of the calculating as the feed-forward input voltage to the delay module and the filtering module if the absolute value of the reference voltage is greater than the first threshold, and the reference voltage is negative; the delay module is configured to receive the feed-forward input voltage transmitted by the anti-steady-state-disturbance processing module, perform delay processing on the feed-forward input voltage to generate the previous-moment input voltage, and transmit the previous-moment input voltage to the anti-steady-state-disturbance processing module; and the filtering module is configured to receive the feed-forward input voltage transmitted by the anti-steady-state-disturbance processing module, perform filtering processing on the feed-forward input voltage, and output the feed-forward input voltage that is obtained by means of filtering processing.

With reference to the first possible implementation manner of the first aspect, in a second possible implementation manner, the anti-steady-state-disturbance processing module is further configured to, when the absolute value of the reference voltage is greater than the first threshold and less than a second threshold, and the reference voltage is positive, calculate the sum of the previous-moment input voltage and the preset step rate, and output the result of the calculating as the feed-forward input voltage, where the second threshold is a positive number; when the absolute value of the reference voltage is greater than the first threshold and less than the second threshold, and the reference voltage is negative, calculate the difference of the previous-moment input voltage minus the preset step rate, and output the result of the calculating as the feed-forward input voltage; and when the absolute value of the reference voltage is greater than or equal to the second threshold, output the sampled input voltage as the feed-forward input voltage.

With reference to the second possible implementation manner of the first aspect, in a third possible implementation manner, the anti-steady-state-disturbance processing module includes a first subtraction circuit, a first comparator, a second comparator, a third comparator, a fourth comparator, a fifth comparator, a sixth comparator, a first AND gate circuit, a second AND gate circuit, a first OR gate circuit, a first controller, a second controller, and a third controller, where the sampled input voltage is input to a non-inverting input end of the first subtraction circuit, and the previous-moment input voltage is input to an inverting input end of the first subtraction circuit, where the first subtraction circuit is configured to calculate the difference of the sampled input voltage minus the previous-moment input voltage, and output the difference as the reference voltage, and an output end of the first subtraction circuit is separately connected to a non-inverting input end of the first comparator, an inverting input end of the second comparator, an inverting input end of the third comparator, a non-inverting input end of the fourth comparator, a non-inverting input end of a fifth comparator, and an inverting input end of the sixth comparator; the reference voltage is input to the non-inverting input end of the first comparator, the first threshold is input to an inverting input end of the first comparator, and an output end of the first comparator is connected to a first input end of the first AND gate circuit; the second threshold is input to a non-inverting input end of the second comparator, the reference voltage is input to the inverting input end of the second comparator, and an output end of the second comparator is connected to a second input end of the first AND gate circuit; an output end of the first AND gate circuit is connected to an input end of the first controller; the first controller is configured to, when the first AND gate circuit outputs a high level, calculate the sum of the previous-moment input voltage and the preset step rate, and output the result of the calculating as the feed-forward input voltage; an opposite number of the first threshold is input to a non-inverting input end of the third comparator, the reference voltage is input to the inverting input end of the third comparator, and an output end of the third comparator is connected to a first input end of the second AND gate circuit; the reference voltage is input to the non-inverting input end of the fourth comparator, an opposite number of the second threshold is input to the inverting input end of the fourth comparator, and an output end of the fourth comparator is connected to a second input end of the second AND gate circuit; an output end of the second AND gate circuit is connected to an input end of the second controller; the second controller is configured to, when the second AND gate circuit outputs a high level, calculate the difference of the previous-moment input voltage minus the preset step rate, and output the result of the calculating as the feed-forward input voltage; the reference voltage is input to the non-inverting input end of the fifth comparator, the second threshold is input to an inverting input end of the fifth comparator, and an output end of the fifth comparator is connected to a first input end of the first OR gate circuit; the opposite number of the second threshold is input to a non-inverting input end of the sixth comparator, the reference voltage is input to the inverting input end of the sixth comparator, and an output end of the sixth comparator is connected to a second input end of the first OR gate circuit; an output end of the first OR gate circuit is connected to an input end of the third controller; and the third controller is configured to, when the first OR gate circuit outputs a high level, output the sampled input voltage as the feed-forward input voltage.

With reference to the second possible implementation manner of the first aspect, in a fourth possible implementation manner, the anti-steady-state-disturbance processing module includes a second subtraction circuit, an absolute value circuit, a seventh comparator, an eighth comparator, a ninth comparator, a tenth comparator, a NOT gate circuit, a third AND gate circuit, a fourth AND gate circuit, a fifth AND gate circuit, a fourth controller, a fifth controller, and a sixth controller, where the sampled input voltage is input to a non-inverting input end of the second subtraction circuit, the previous-moment input voltage is input to an inverting input end of the first subtraction circuit, where the first subtraction circuit is configured to calculate the difference of the sampled input voltage minus the previous-moment input voltage, and output the difference as the reference voltage, and an output end of the first subtraction circuit is connected to an input end of the absolute value circuit; the absolute value circuit is configured to perform an absolute value operation on the reference voltage to generate the absolute value of the reference voltage, and an output end of the absolute value circuit is separately connected to a non-inverting input end of the seventh comparator, an inverting input end of the eighth comparator, and a non-inverting input end of the tenth comparator; the absolute value of the reference voltage is input to the non-inverting input end of the seventh comparator, the first threshold is input to an inverting input end of the seventh comparator, and an output end of the seventh comparator is connected to a first input end of the third AND gate circuit; the second threshold is input to a non-inverting input end of the eighth comparator, the absolute value of the reference voltage is input to the inverting input end of the eighth comparator, and an output end of the eighth comparator is connected to a second input end of the third AND gate circuit; an output end of the third AND gate circuit is separately connected to a first input end of the fourth AND gate circuit and a first input end of the fifth AND gate circuit; the sampled input voltage is input to a non-inverting input end of the ninth comparator, the previous-moment voltage is input to an inverting input end of the ninth comparator, and an output end of the ninth comparator is separately connected to a second input end of the fourth AND gate circuit and an input end of the NOT gate circuit; an output end of the fourth AND gate circuit is connected to an input end of the fourth controller; the fourth controller is configured to, when the fourth AND gate circuit outputs a high level, calculate the sum of the previous-moment input voltage and the preset step rate, and output the result of the calculating as the feed-forward input voltage; an output end of the NOT gate circuit is connected to a second input end of the fifth AND gate circuit; an output end of the fifth AND gate circuit is connected to an input end of the fifth controller; the fifth controller is configured to, when the fifth AND gate circuit outputs a high level, calculate the difference of the previous-moment input voltage minus the preset step rate, and output the result of the calculating as the feed-forward input voltage; the absolute value of the reference voltage is input to the non-inverting input end of the tenth comparator, the second threshold is input to an inverting input end of the tenth comparator, and an output end of the tenth comparator is connected to an input end of the sixth controller; and the sixth controller is configured to: when the tenth comparator outputs a high level, output the sampled input voltage as the feed-forward input voltage.

With reference to the first possible implementation manner of the first aspect, in a fifth possible implementation manner, the sampling module includes a first analog to digital converter, where the first analog to digital converter is configured to receive the input voltage, perform analog-to-digital conversion on the input voltage, and output the sampled input voltage.

With reference to the first possible implementation manner of the first aspect, in a sixth possible implementation manner, the delay module includes a delayer, where the delayer is configured to receive the feed-forward input voltage, perform delay processing on the feed-forward input voltage, and output the previous-moment input voltage.

With reference to the first aspect or any possible implementation manner of the first aspect, in a seventh possible implementation manner, the filtering module includes a first filter, where the first filter is configured to receive the feed-forward input voltage output by the anti-steady-state-disturbance processing module, perform filtering processing on the feed-forward input voltage, and output the feed-forward input voltage that is obtained by means of filtering processing.

According to a second aspect, a digitally controlled power source is provided, where the digitally controlled power source includes a power supply control loop, where the power supply control loop is the power supply control loop described in the first aspect or any possible implementation manner of the first aspect.

According to a third aspect, a power control method includes: sampling an input voltage to generate a sampled input voltage; performing anti-steady-state-disturbance processing on the sampled input voltage to generate a feed-forward input voltage; sampling an output voltage to generate a sampled output voltage; and combining the sampled output voltage and the feed-forward input voltage into a stability voltage.

With reference to the third aspect, in a first possible implementation manner, the performing anti-steady-state-disturbance processing on the sampled input voltage to generate a feed-forward input voltage includes: calculating a difference between the sampled input voltage and a previous-moment input voltage, and using a result of the calculating as a reference voltage; outputting the previous-moment input voltage as the feed-forward input voltage if an absolute value of the reference voltage is less than or equal to a first threshold; calculating a sum of the previous-moment input voltage and a preset step rate, and outputting a result of the calculating as the feed-forward input voltage if the absolute value of the reference voltage is greater than the first threshold, and the reference voltage is positive; calculating a difference of the previous-moment input voltage minus the preset step rate, and outputting a result of the calculating as the feed-forward input voltage if the absolute value of the reference voltage is greater than the first threshold, and the reference voltage is negative; performing delay processing on the feed-forward input voltage to generate the previous-moment input voltage; and performing filtering processing on the feed-forward input voltage, and outputting the feed-forward input voltage that is obtained by means of filtering processing.

With reference to the first possible implementation manner of the third aspect, in a second possible implementation manner, the calculating a sum of the previous-moment input voltage and a preset step rate, and outputting a result of the calculating as the feed-forward input voltage if the absolute value of the reference voltage is greater than the first threshold, and the reference voltage is positive includes: calculating the difference of the previous-moment input voltage minus the preset step rate, and outputting the result of the calculating as the feed-forward input voltage if the absolute value of the reference voltage is greater than the first threshold and less than the second threshold, and the reference voltage is positive; the calculating a difference of the previous-moment input voltage minus the preset step rate, and outputting a result of the calculating as the feed-forward input voltage if the absolute value of the reference voltage is greater than the first threshold, and the reference voltage is negative includes calculating the difference of the previous-moment input voltage minus the preset step rate, and outputting the result of the calculating as the feed-forward input voltage if the absolute value of the reference voltage is greater than the first threshold and less than the second threshold, and the reference voltage is negative; and the method further includes outputting the sampled input voltage as the feed-forward input voltage if the absolute value of the reference voltage is greater than or equal to the second threshold.

According to the power supply control method and device provided in the embodiments of the present invention, an input voltage is sampled to generate a sampled input voltage, anti-steady-state-disturbance processing is performed on the sampled input voltage to generate a feed-forward input voltage, an output voltage is sampled to generate a sampled output voltage, and the sampled output voltage and the feed-forward input voltage that is output by a feed-forward digital control circuit are combined into a stability voltage, thereby alleviating impact of a power source input disturbance on an output voltage.

BRIEF DESCRIPTION OF DRAWINGS

To describe the technical solutions in the embodiments of the present invention more clearly, the following briefly introduces the accompanying drawings required for describing the embodiments. The accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. The described embodiments are merely a part rather than all of the embodiments of the present invention. All other embodiments obtained by a person of ordinary skill in the art based on the embodiments of the present invention without creative efforts shall fall within the protection scope of the present invention.

Figure 1:
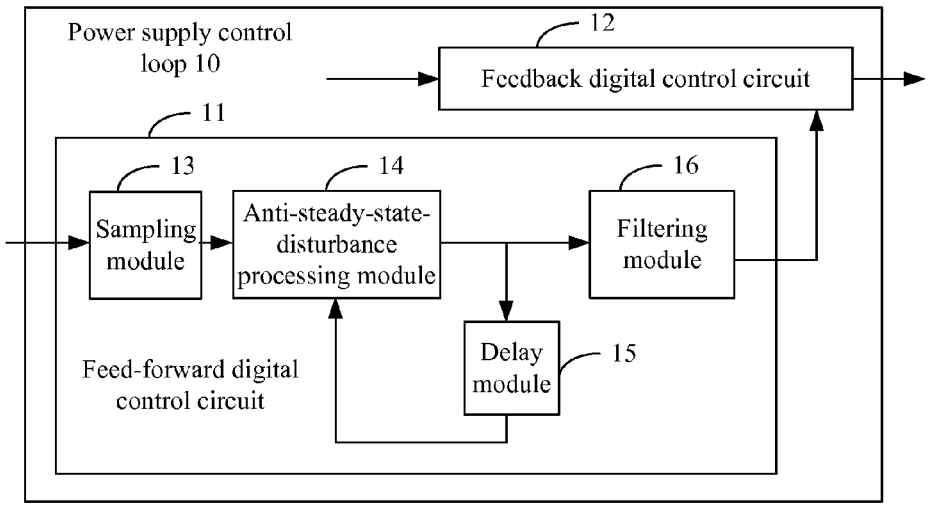
FIG. 1 is a schematic structural diagram of a power supply control loop according to an embodiment of the present invention.

An embodiment of the present invention provides a power supply control loop, and as shown in FIG. 1, the power supply control loop 10 includes a feed-forward digital control circuit 11 and a feedback digital control circuit 12.

The feed-forward digital control circuit 11 is configured to sample an input voltage to generate a sampled input voltage, perform anti-steady-state-disturbance processing on the sampled input voltage to generate a feed-forward input voltage, and output the feed-forward input voltage.

The feedback digital control circuit 12 is configured to sample an output voltage to generate a sampled output voltage, and combine the sampled output voltage and the feed-forward input voltage that is output by the feed-forward digital control circuit 11 into a stability voltage.

According to the power supply control loop provided in the embodiment of the present invention, an input voltage is sampled to generate a sampled input voltage, anti-steady-state-disturbance processing is performed on the sampled input voltage to generate a feed-forward input voltage, an output voltage is sampled to generate a sampled output voltage, and the sampled output voltage and the feed-forward input voltage that is output by a feed-forward digital control circuit are combined into a stability voltage, thereby alleviating impact of a power source input disturbance on an output voltage.

Optionally, as shown in FIG. 1, the feed-forward digital control circuit 11 includes a sampling module 13, an anti-steady-state-disturbance processing module 14, a delay module 15, and a filtering module 16, where an output end of the sampling module 13 is connected to an input end of the anti-steady-state-disturbance processing module 14, an output end of the delay module 15 is connected to an input end of the anti-steady-state-disturbance processing module 14, an output end of the anti-steady-state-disturbance processing module 14 is connected to an input end of the delay module 15, and an output end of the anti-steady-state-disturbance processing module 14 is connected to an input end of the filtering module 16. Certainly, in the embodiment, one structure of the feed-forward digital control circuit 11 is used as a mere example to describe content of the present invention, which does not indicate that the feed-forward digital control circuit 11 of the present invention is limited to this one structure.

The sampling module 13 is configured to sample the input voltage, and transmit the sampled input voltage to the anti-steady-state-disturbance processing module 14.

The anti-steady-state-disturbance processing module 14 is configured to receive the sampled input voltage transmitted by the sampling module 13, receive a previous-moment input voltage transmitted by the delay module 15, calculate a difference between the sampled input voltage and the previous-moment input voltage, and use a result of the calculating as a reference voltage; output the previous-moment input voltage as the feed-forward input voltage if an absolute value of the reference voltage is less than or equal to a first threshold, where the first threshold is a positive number; calculate a sum of the previous-moment input voltage and a preset step rate, and output a result of the calculating as the feed-forward input voltage if the absolute value of the reference voltage is greater than the first threshold, and the reference voltage is positive; and calculate a difference of the previous-moment input voltage minus the preset step rate, and output a result of the calculating as the feed-forward input voltage if the absolute value of the reference voltage is greater than the first threshold, and the reference voltage is negative.

The delay module 15 is configured to receive the feed-forward input voltage transmitted by the anti-steady-state-disturbance processing module 14, perform delay processing on the feed-forward input voltage to generate the previous-moment input voltage, and transmit the previous-moment input voltage to the anti-steady-state-disturbance processing module 14.

The filtering module 16 is configured to receive the feed-forward input voltage transmitted by the anti-steady-state-disturbance processing module 14, perform filtering processing on the feed-forward input voltage, and output the feed-forward input voltage that is obtained by means of filtering processing.

In this way, when the absolute value of the reference voltage is greater than the first threshold, and the reference voltage is positive, it is indicated that the sampled input voltage is greater than the previous-moment input voltage, and therefore, the sum of the previous-moment input voltage and the preset step rate is calculated, and the result of the calculating is output as the feed-forward input voltage, so that the feed-forward input voltage approaches the sampled input voltage at the step rate. Similarly, when the absolute value of the reference voltage is greater than the first threshold, and the reference voltage is negative, it is indicated that the sampled input voltage is less than the previous-moment input voltage, and therefore, the difference of the previous-moment input voltage minus the preset step rate is calculated, and the result of the calculating is output as the feed-forward input voltage, so that the feed-forward input voltage approaches the sampled input voltage at the step rate. In this way, the feed-forward input voltage is slowly updated, and the feed-forward input voltage and the sampled output voltage is combined, so that the output voltage can be more steady, thereby alleviating impact of a disturbance on the output voltage.

Further optionally, the anti-steady-state-disturbance processing module 14 is configured to, when the absolute value of the reference voltage is greater than the first threshold and less than a second threshold, and the reference voltage is positive, calculate the sum of the previous-moment input voltage and the preset step rate, and output the result of the calculating as the feed-forward input voltage, where the second threshold is a positive number; when the absolute value of the reference voltage is greater than the first threshold and less than the second threshold, and the reference voltage is negative, calculate the difference of the previous-moment input voltage minus the preset step rate, and output the result of the calculating as the feed-forward input voltage; and when the absolute value of the reference voltage is greater than or equal to the second threshold, output the sampled input voltage as the feed-forward input voltage.

In this way, when an absolute value of the difference between the sampled input voltage and the previous-moment input voltage, that is, the absolute value of the reference voltage, is less than or equal to the first threshold, it is indicated that a disturbance is very small, and the feed-forward input voltage output by the feed-forward digital control circuit 11 does not need to be updated but only needs to be maintained as the previous-moment input voltage; when the absolute value of the reference voltage is greater than the first threshold and less than the second threshold, it is indicated that the disturbance is in an adjustable range, and therefore, the feed-forward input voltage that is output is slowly updated by using the step rate, so as to approach the sampled input voltage, and updating slowly in this way can prevent a disturbance brought by the updating from being greater than a disturbance brought by an error; and when the absolute value of the reference voltage is greater than the second threshold, it is indicated that impact of a disturbance is great, and the sampled input voltage needs to be output immediately to ensure a feed-forward response speed. Optionally, the step rate may be set according to a specific situation, on which no limitation is imposed by the present invention.

Figure 2:
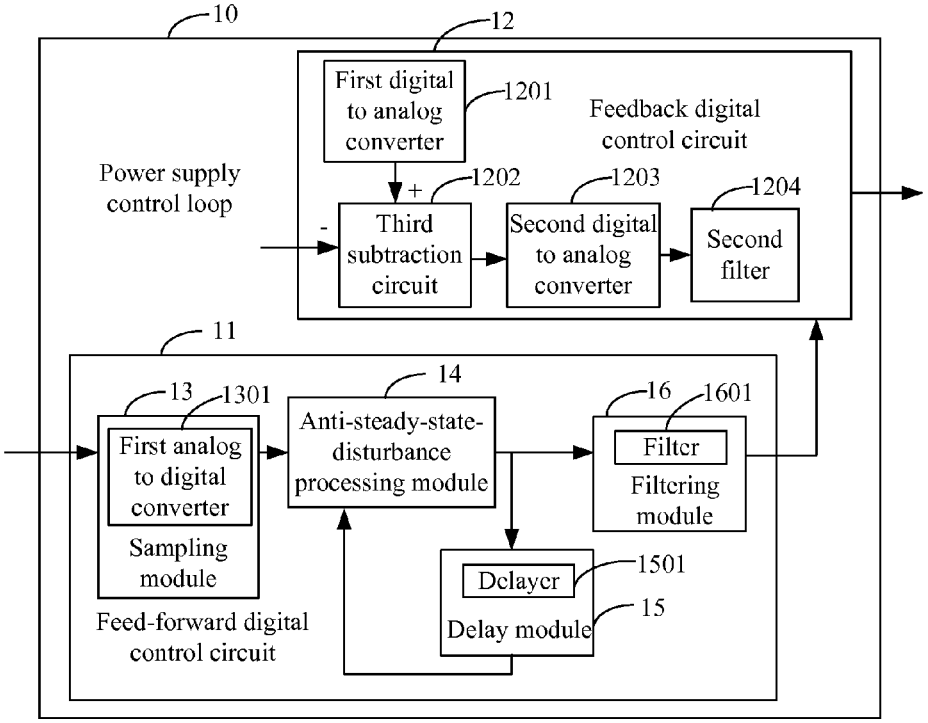
FIG. 2 is a schematic structural diagram of another power supply control loop according to an embodiment of the present invention.

Further optionally, as shown in FIG. 2, the sampling module 13 includes a first analog to digital converter 1301, the delay module 15 includes a delayer 1501, and the filtering module 16 includes a first filter 1601.

The first analog to digital converter 1301 is configured to receive the input voltage, perform analog-to-digital conversion on the input voltage, and output the sampled input voltage.

The delayer 1501 is configured to receive the feed-forward input voltage, perform delay processing on the feed-forward input voltage, and output the previous-moment input voltage.

The first filter 1601 is configured to receive the feed-forward input voltage output by the anti-steady-state-disturbance processing module 14, perform filtering processing on the feed-forward input voltage, and output the feed-forward input voltage that is obtained by means of filtering processing.

The feedback digital control circuit 12 may include a first digital to analog converter 1201, a third subtraction circuit 1202, a second analog to digital converter 1203, and a second filter 1204. The output voltage is input to an inverting input end of the third subtraction circuit 1202, a non-inverting input end of the third subtraction circuit 1202 is connected to an output end of the first digital to analog converter 1201, an output end of the third subtraction circuit 1202 is connected to an input end of the second analog to digital converter 1203, and an output end of the second analog to digital converter 1203 is connected to an input end of the second filter 1204. Certainly, in this embodiment, a mere example is used to describe an implementable circuit structure of the feedback digital control circuit 12, which does not indicate that the feedback digital control circuit 12 in the present invention is limited to this structure, and no limitation is imposed by the present invention on a specific structure of the feedback digital control circuit 12.

Figure 3:
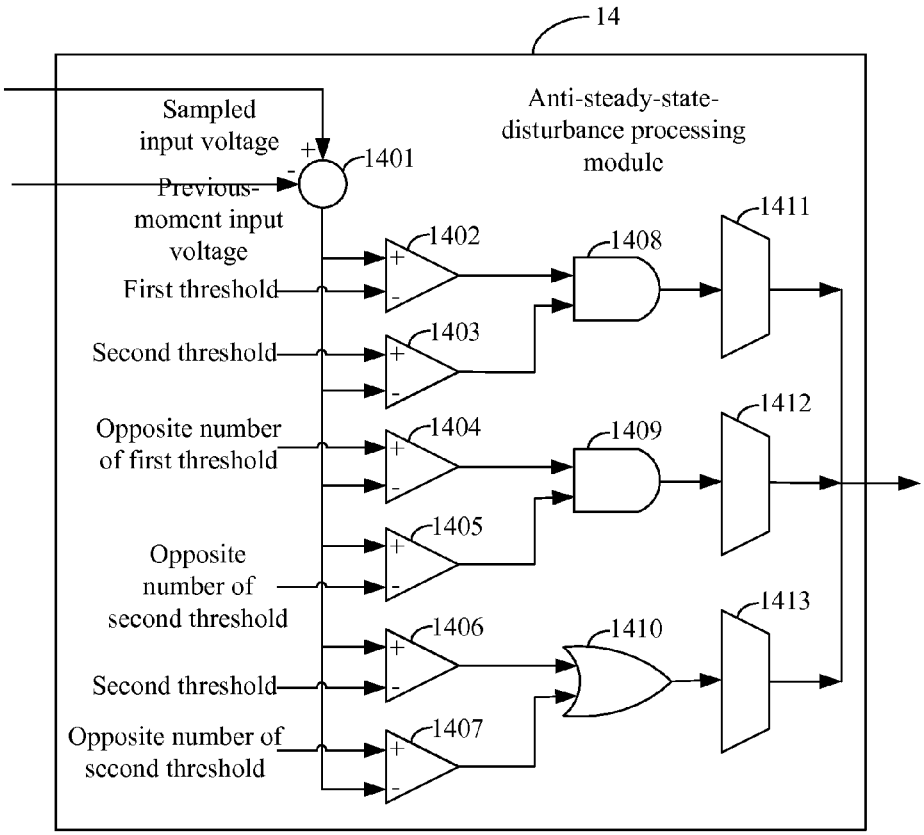
FIG. 3 is a schematic structural diagram of an anti-steady-state-disturbance processing module according to an embodiment of the present invention.

In one application scenario, as shown in FIG. 3, the anti-steady-state-disturbance processing module 14 includes: a first subtraction circuit 1401, a first comparator 1402, a second comparator 1403, a third comparator 1404, a fourth comparator 1405, a fifth comparator 1406, a sixth comparator 1407, a first AND gate circuit 1408, a second AND gate circuit 1409, a first OR gate circuit 1410, a first controller 1411, a second controller 1412, and a third controller 1413. It should be noted that, the structure of the anti-steady-state-disturbance processing module 14 shown in FIG. 3 is only a specific implementation manner of the present invention, and does not indicate that the anti-steady-state-disturbance processing module 14 of the present invention is limited to the structure.

The sampled input voltage is input to a non-inverting input end of the first subtraction circuit 1401, the previous-moment input voltage is input to an inverting input end of the first subtraction circuit 1401, the first subtraction circuit 1401 is configured to calculate the difference of the sampled input voltage minus the previous-moment input voltage, and output the difference as the reference voltage, and an output end of the first subtraction circuit 1401 is separately connected to a non-inverting input end of the first comparator 1402, an inverting input end of the second comparator 1403, an inverting input end of the third comparator 1404, a non-inverting input end of the fourth comparator 1405, a non-inverting input end of a fifth comparator 1406, and an inverting input end of the sixth comparator 1407.

The reference voltage is input to the non-inverting input end of the first comparator 1402, the first threshold is input to an inverting input end of the first comparator 1402, and an output end of the first comparator 1402 is connected to a first input end of the first AND gate circuit 1408.

The second threshold is input to a non-inverting input end of the second comparator 1403, the reference voltage is input to the inverting input end of the second comparator 1403, and an output end of the second comparator 1403 is connected to a second input end of the first AND gate circuit 1408.

An output end of the first AND gate circuit 1408 is connected to an input end of the first controller 1411.

The first controller 1411 is configured to, when the first AND gate circuit 1408 outputs a high level, calculate the sum of the previous-moment input voltage and the preset step rate, and output the result of the calculating as the feed-forward input voltage.

An opposite number of the first threshold is input to a non-inverting input end of the third comparator 1404, the reference voltage is input to the inverting input end of the third comparator 1404, and an output end of the third comparator 1404 is connected to a first input end of the second AND gate circuit 1409.

The reference voltage is input to the non-inverting input end of the fourth comparator 1405, an opposite number of the second threshold is input to the inverting input end of the fourth comparator 1405, and an output end of the fourth comparator 1405 is connected to a second input end of the second AND gate circuit 1409.

An output end of the second AND gate circuit 1409 is connected to an input end of the second controller 1412.

The second controller 1412 is configured to, when the second AND gate circuit 1409 outputs a high level, calculate the difference of the previous-moment input voltage minus the preset step rate, and output the result of the calculating as the feed-forward input voltage.

The reference voltage is input to the non-inverting input end of the fifth comparator 1406, the second threshold is input to an inverting input end of the fifth comparator 1406, and an output end of the fifth comparator 1406 is connected to a first input end of the first OR gate circuit 1410.

The opposite number of the second threshold is input to a non-inverting input end of the sixth comparator 1407, the reference voltage is input to the inverting input end of the sixth comparator 1407, and an output end of the sixth comparator 1407 is connected to a second input end of the first OR gate circuit 1410.

An output end of the first OR gate circuit 1410 is connected to an input end of the third controller 1413.

The third controller 1413 is configured to, when the first OR gate circuit 1410 outputs a high level, output the sampled input voltage as the feed-forward input voltage.

Specifically and optionally, for the anti-steady-state-disturbance processing module 14 shown in FIG. 3, there may be four situations for the value of the reference voltage.

In a first situation, the reference voltage is greater than the first threshold and the reference voltage is less than the second threshold. For the first comparator 1402, when a value input to the non-inverting input end of the first comparator 1402 is greater than a value input to the inverting input end of the first comparator 1402, the first comparator 1402 outputs a high level, that is, when the reference voltage is greater than the first threshold, the first comparator 1402 outputs a high level. Similarly, for the second comparator 1403, when the second threshold is greater than the reference voltage, the second comparator 1403 outputs a high level. The output end of the first comparator 1402 and the output end of the second comparator 1403 are separately connected to the two input ends of the first AND gate circuit 1408. When the reference voltage is greater than the first threshold and the reference voltage is less than the second threshold, that is, when both the first comparator 1402 and the second comparator 1403 output a high level, the first AND gate circuit 1408 outputs a high level. When the first AND gate circuit 1408 outputs a high level, the first controller 1411 calculates the sum of the previous-moment input voltage and the step rate, and outputs the result of the calculating as the feed-forward input voltage, so that the feed-forward input voltage that is output slowly approaches the sampled input voltage.

In a second situation, the reference voltage is less than the opposite value of the first threshold and the reference voltage is greater than the opposite value of the second threshold. For the third comparator 1404, when the opposite number of the first threshold is greater than the reference voltage, the third comparator 1404 outputs a high level. For the fourth comparator 1405, when the reference voltage is greater than the opposite number of the second threshold, the fourth comparator 1405 outputs a high level. The output end of the third comparator 1404 and the output end of the fourth comparator 1405 are separately connected to the two input ends of the second AND gate circuit 1409. When the reference voltage is less than the opposite number of the first threshold and the reference voltage is greater than the opposite number of the second threshold, that is, when both the third comparator 1404 and the fourth comparator 1405 output a high level, the second AND gate circuit 1409 outputs a high level. When the second AND gate circuit 1409 outputs a high level, the second controller 1412 calculates the difference of the previous-moment input voltage minus the preset step rate and outputs the result of the calculating as the feed-forward input voltage, so that the feed-forward input voltage that is output slowly approaches the sampled input voltage.

With the first situation and the second situation combined, when the absolute value of the reference voltage is greater than the first threshold and less than the second threshold, the previous-moment input voltage is made to slowly approach the sampled input voltage at the step rate.

In a third situation, the reference voltage is greater than the second threshold. For the fifth comparator 1406, when the reference voltage is greater than the second threshold, the fifth comparator 1406 outputs a high level.

In a fourth situation, the reference voltage is less than the opposite number of the second threshold. For the sixth comparator 1407, when the reference voltage is less than the opposite number of the second threshold, the sixth comparator 1407 outputs a high level.

With the third situation and the fourth situation combined, the output end of the fifth comparator 1406 and the output end of the sixth comparator 1407 are separately connected to the two input ends of the first OR gate circuit 1410. That is, the reference voltage is greater than the second threshold or the reference voltage is less than the opposite number of the second threshold, and the absolute value of the reference voltage is greater than the second threshold, and then the first OR gate circuit 1410 outputs a high level. When the first OR gate circuit 1410 outputs a high level, the third controller 1413 outputs the sampled input voltage as the feed-forward input voltage.

In addition, when the absolute value of the reference voltage is less than or equal to the first threshold, none of the first controller 1411, the second controller 1412, and the third controller 1413 meets an output condition, and therefore, the feed-forward digital control circuit 11 directly outputs the previous-moment input voltage.

Figure 4:
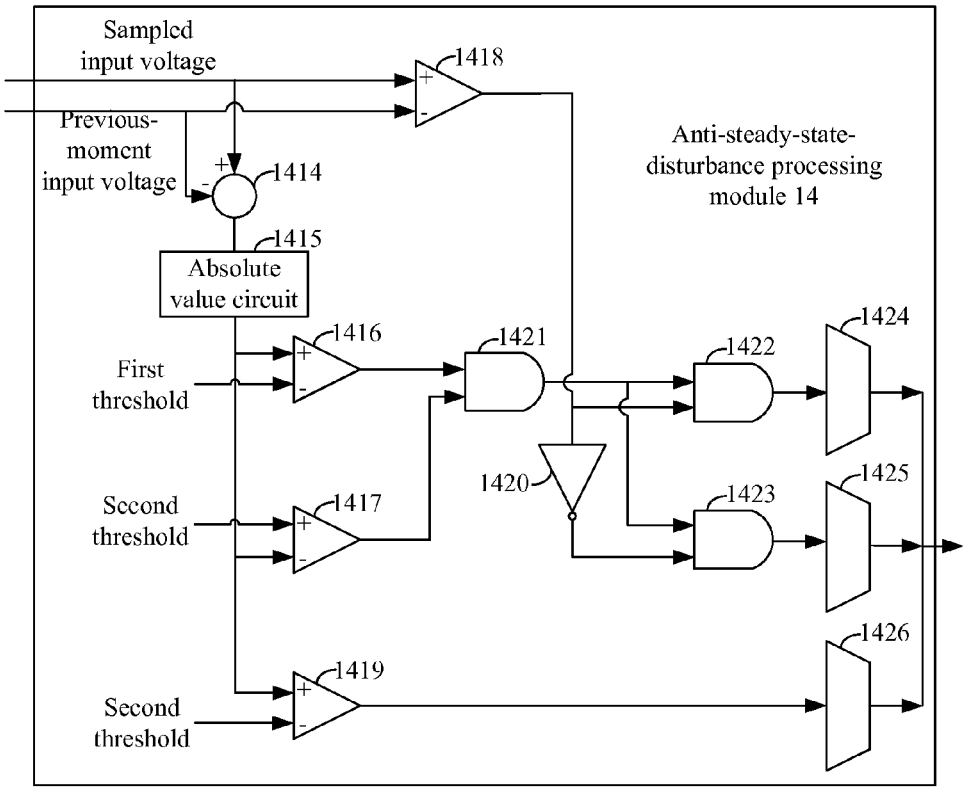
FIG. 4 is a schematic structural diagram of another anti-steady-state-disturbance processing module according to an embodiment of the present invention.

In another application scenario, as shown in FIG. 4, the anti-steady-state-disturbance processing module 14 includes a second subtraction circuit 1414, an absolute value circuit 1415, a seventh comparator 1416, an eighth comparator 1417, a ninth comparator 1418, a tenth comparator 1419, a NOT gate circuit 1420, a third AND gate circuit 1421, a fourth AND gate circuit 1422, a fifth AND gate circuit 1423, a fourth controller 1424, a fifth controller 1425, and a sixth controller 1426. It should be noted that the structure of the anti-steady-state-disturbance processing module 14 shown in FIG. 4 is only a specific implementation manner of the present invention, and does not indicate that the anti-steady-state-disturbance processing module 14 of the present invention is limited to the structure.

The sampled input voltage is input to a non-inverting input end of the second subtraction circuit 1414, the previous-moment input voltage is input to an inverting input end of the second subtraction circuit 1414, where the second subtraction circuit 1414 is configured to calculate the difference of the sampled input voltage minus the previous-moment input voltage, and output the difference as the reference voltage, and an output end of the second subtraction circuit 1414 is connected to an input end of the absolute value circuit 1415.

The absolute value circuit 1415 is configured to perform an absolute value operation on the reference voltage to generate the absolute value of the reference voltage, and an output end of the absolute value circuit 1415 is separately connected to a non-inverting input end of the seventh comparator 1416, an inverting input end of the eighth comparator 1417, and a non-inverting input end of the tenth comparator 1419.

The absolute value of the reference voltage is input to the non-inverting input end of the seventh comparator 1416, the first threshold is input to an inverting input end of the seventh comparator 1416, and an output end of the seventh comparator 1416 is connected to a first input end of the third AND gate circuit 1421.

The second threshold is input to a non-inverting input end of the eighth comparator 1417, the absolute value of the reference voltage is input to the inverting input end of the eighth comparator 1417, and an output end of the eighth comparator 1417 is connected to a second input end of the third AND gate circuit 1421.

An output end of the third AND gate circuit 1421 is separately connected to a first input end of the fourth AND gate circuit 1422 and a first input end of the fifth AND gate circuit 1423.

The sampled input voltage is input to a non-inverting input end of the ninth comparator 1418, the previous-moment voltage is input to an inverting input end of the ninth comparator 1418, and an output end of the ninth comparator 1418 is separately connected to a second input end of the fourth AND gate circuit 1422 and an input end of the NOT gate circuit 1420.

An output end of the fourth AND gate circuit 1422 is connected to an input end of the fourth controller 1424.

The fourth controller 1424 is configured to, when the fourth AND gate circuit 1422 outputs a high level, calculate the sum of the previous-moment input voltage and the preset step rate, and output the result of the calculating as the feed-forward input voltage.

An output end of the NOT gate circuit 1420 is connected to a second input end of the fifth AND gate circuit 1423.

An output end of the fifth AND gate circuit 1423 is connected to an input end of the fifth controller 1425.

The fifth controller 1425 is configured to, when the fifth AND gate circuit 1423 outputs a high level, calculate the difference of the previous-moment input voltage minus the preset step rate, and output the result of the calculating as the feed-forward input voltage.

The absolute value of the reference voltage is input to the non-inverting input end of the tenth comparator 1419, the second threshold is input to an inverting input end of the tenth comparator 1419, and an output end of the tenth comparator 1419 is connected to an input end of the sixth controller 1426.

The sixth controller 1426 is configured to, when the tenth comparator 1419 outputs a high level, output the sampled input voltage as the feed-forward input voltage.

Specifically and optionally, for the anti-steady-state-disturbance processing module 14 shown in FIG. 4, there may be two situations for the value of the reference voltage.

A first situation is corresponding to the seventh comparator 1416 and the eighth comparator 1417. When the absolute value of the reference voltage is greater than a first threshold, the seventh comparator 1416 outputs a high level. When the absolute value of the reference voltage is less than the second threshold, the eighth comparator 1417 outputs a high level. The output end of the seventh comparator 1416 and the output end of the eighth comparator 1417 are separately connected to the two input ends of the third AND gate circuit 1421. That is, when the absolute value of the reference voltage is greater than the first threshold and less than the second threshold, the third AND gate circuit 1421 outputs a high level.

Further, there are two output manners in the first situation. 1. In a first manner, for the ninth comparator 1418, when the sampled input voltage is greater than the previous-moment input voltage, that is, the reference voltage is positive, the output end of the ninth comparator 1418 and the output end of the third AND gate circuit 1421 are separately connected to the two input ends of the fourth AND gate circuit 1422. Then, when the absolute value of the reference voltage is greater than the first threshold and less than the second threshold, and the sampled input voltage is greater than the previous-moment input voltage, that is, the reference voltage is positive, the fourth AND gate circuit 1422 outputs a high level. When the fourth AND gate circuit 1422 outputs a high level, the fourth controller 1424 calculates the sum of the previous-moment input voltage and the preset step rate, and outputs the result of the calculating as the feed-forward input voltage. 2. In a second manner, for the ninth comparator 1418, when the sampled input voltage is less than the previous-moment input voltage, the ninth comparator 1418 outputs a low level, the output end of the ninth comparator 1418 is connected to the input end of the NOT gate circuit 1420, the NOT gate circuit 1420 outputs a high level, and the output end of the NOT gate circuit 1420 and the output end of the third AND gate circuit 1421 are separately connected to the two input ends of the fifth AND gate circuit 1423. Then, when the absolute value of the reference voltage is greater than the first threshold and less than the second threshold, and the sampled input voltage is less than the previous-moment input voltage, that is, the reference voltage is negative, the fifth AND gate circuit 1423 outputs a high level. When the fifth AND gate circuit 1423 outputs a high level, the fifth controller 1425 calculates the difference of the previous-moment input voltage minus the preset step rate, and outputs the result of the calculating as the feed-forward input voltage.

A second situation is corresponding to the tenth comparator 1419. When the absolute value of the reference voltage is greater than the second threshold, the tenth comparator 1419 outputs a high level. When the tenth comparator 1419 outputs a high level, the sixth controller 1426 outputs the sampled input voltage as the feed-forward input voltage.

According to the power supply control loop provided in the embodiment of the present invention, an input voltage is sampled to generate a sampled input voltage, anti-steady-state-disturbance processing is performed on the sampled input voltage to generate a feed-forward input voltage, an output voltage is sampled to generate a sampled output voltage, and the sampled output voltage and the feed-forward input voltage that is output by a feed-forward digital control circuit are combined into a stability voltage, thereby alleviating impact of a power source input disturbance on an output voltage.

Figure 5:
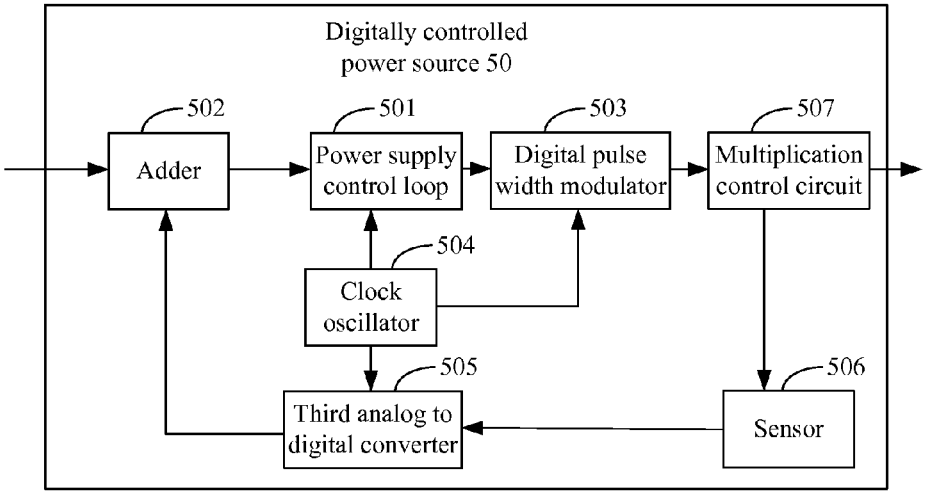
FIG. 5 is a schematic structural diagram of a digitally controlled power source according to an embodiment of the present invention.

Based on the foregoing embodiment corresponding to FIG. 1, an embodiment of the present invention provides a digitally controlled power source, and as shown in FIG. 5, the digitally controlled power source 50 includes a power supply control loop 501.

The power supply control loop 501 is the power supply control loop described in either embodiment corresponding to FIG. 1 or FIG. 2.

Optionally, the digitally controlled power source 50 may further include an adder 502, a digital pulse width modulator 503, a clock oscillator 504, a third analog to digital converter 505, a sensor 506, and a multiplication control circuit 507.

According to the digitally controlled power source provided in the embodiment of the present invention, an input voltage is sampled to generate a sampled input voltage, anti-steady-state-disturbance processing is performed on the sampled input voltage to generate a feed-forward input voltage, an output voltage is sampled to generate a sampled output voltage, and the sampled output voltage and the feed-forward input voltage that is output by a feed-forward digital control circuit are combined into a stability voltage, thereby alleviating impact of a power source input disturbance on an output voltage.

Figure 6:
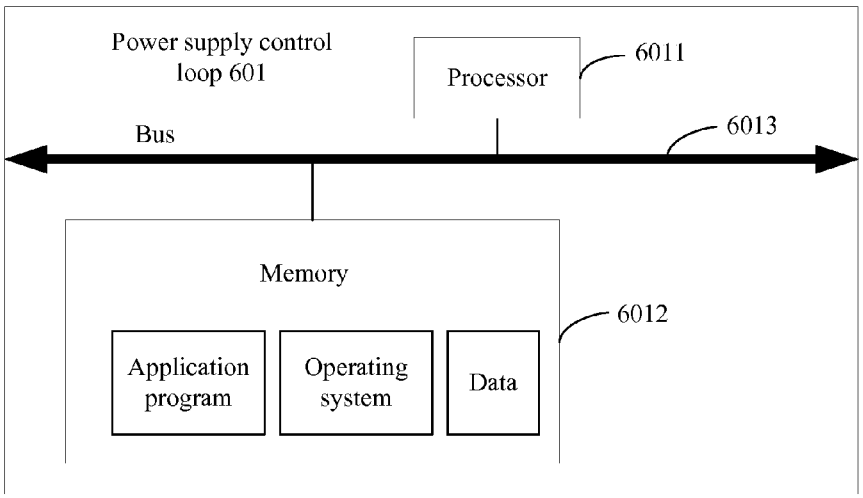
FIG. 6 is a schematic structural diagram of a power supply control loop according to another embodiment of the present invention.

Another embodiment of the present invention provides a power supply control loop 601, and as shown in FIG. 6, the device may be built in or may be a micro-processing computer, for example, a general-purpose computer, a customized computer, or a portable device such as a mobile terminal or a tablet computer. The power supply control loop 601 includes at least one processor 6011, a memory 6012, and a bus 6013, and the at least one processor 6011 and the memory 6012 are connected and communicate with each other by using the bus 6013.

The bus 6013 may be an industry standard architecture (ISA) bus, a Peripheral Component Interconnect (PCI) bus, an extended industry standard architecture (EISA) bus, or the like. The bus 6013 may be divided into an address bus, a data bus, a control bus, and the like. For the convenience of representation, the bus in FIG. 6 is represented by using only one solid line, but it does not mean that there is only one bus or only one type of bus.

The memory 6012 is configured to store the executing application program code of the solutions of the present invention, where the application program code used to execute the solutions of the present invention is stored in the memory and is controlled by the processor 6011 in execution.

The memory may be but are not limited to a read-only memory (ROM) or another type of static storage device that can store static information or an instruction, and a random access memory (RAM) or another type of dynamic storage device that can store information and instructions, or may be an electrically erasable programmable read-only memory (EEPROM), a compact disc read-only memory (CD-ROM) or another optical disk storage or optical disc storage (including a compact disc, a laser disc, an optical disc, a digital versatile disc, a blue-ray disk, and so on), a disk storage medium or another disk storage device, or any other medium that can be used to carry or store expected program code in a command or data structure form and can be accessed by a computer. These memories are connected to the processor by using the bus.

The processor 6011 may be a central processing unit (CPU) 6011, or be an application specific integrated circuit (ASIC), or be configured as one or multiple integrated circuits in the embodiment of the present invention.

The processor 6011 is configured to invoke the program code stored in the memory 6012, so as to execute the operations of the anti-steady-state-disturbance processing module in the foregoing device embodiment corresponding to FIG. 1, and reference for a specific description is made to the device embodiment corresponding to FIG. 1, which is not repeatedly described herein.

According to the power supply control loop provided in the embodiment of the present invention, an input voltage is sampled to generate a sampled input voltage, anti-steady-state-disturbance processing is performed on the sampled input voltage to generate a feed-forward input voltage, an output voltage is sampled to generate a sampled output voltage, and the sampled output voltage and the feed-forward input voltage that is output by a feed-forward digital control circuit are combined into a stability voltage, thereby alleviating impact of a power source input disturbance on an output voltage.

Figure 7:
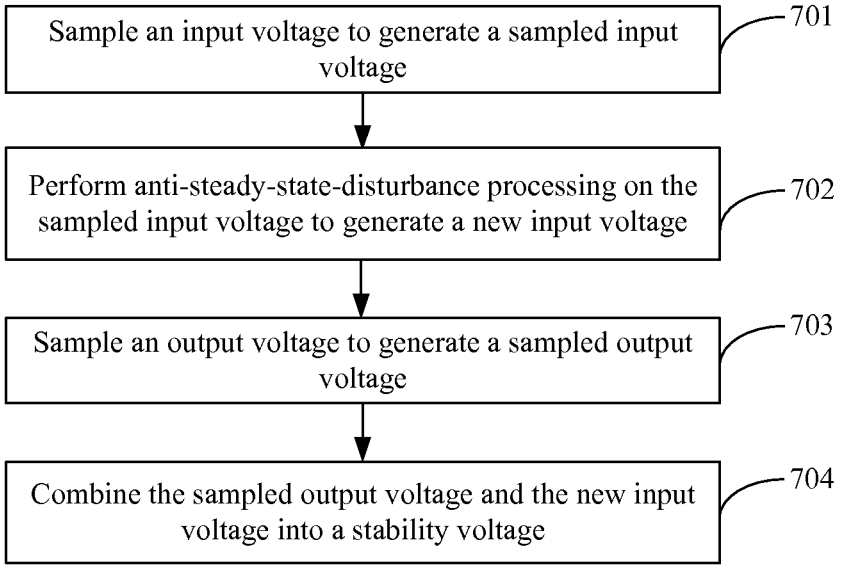
FIG. 7 is a schematic flowchart of a power supply control method according to an embodiment of the present invention.

Based on the foregoing embodiment corresponding to FIG. 1, an embodiment of the present invention provides a power supply control method, applied to the power supply control loop described in the foregoing embodiment corresponding to FIG. 1. As shown in FIG. 7, the following steps are included.

701: Sample an input voltage to generate a sampled input voltage.

702: Perform anti-steady-state-disturbance processing on the sampled input voltage to generate a feed-forward input voltage.

Specifically and optionally, a difference between the sampled input voltage and a previous-moment input voltage is calculated, and a result of the calculating is used as a reference voltage.

If an absolute value of the reference voltage is less than or equal to a first threshold, the previous-moment input voltage is output as the feed-forward input voltage.

If the absolute value of the reference voltage is greater than the first threshold, and the reference voltage is positive, a sum of the previous-moment input voltage and a preset step rate is calculated, and a result of the calculating is output as the feed-forward input voltage.

If the absolute value of the reference voltage is greater than the first threshold, and the reference voltage is negative, a difference of the previous-moment input voltage minus the preset step rate is calculated, and a result of the calculating is output as the feed-forward input voltage.

Delay processing is performed on the feed-forward input voltage to generate the previous-moment input voltage.

Filtering processing is performed on the feed-forward input voltage, and the feed-forward input voltage that is obtained by means of filtering processing is output.

Further optionally, if the absolute value of the reference voltage is greater than the first threshold and less than the second threshold, and the reference voltage is negative, the difference of the previous-moment input voltage minus the preset step rate is calculated, and the result of the calculating is output as the feed-forward input voltage.

If the absolute value of the reference voltage is greater than the first threshold and less than the second threshold, and the reference voltage is negative, the difference of the previous-moment input voltage minus the preset step rate is calculated, and result of the calculating is output as the feed-forward input voltage.

If the absolute value of the reference voltage is greater than or equal to the second threshold, the sampled input voltage is output as the feed-forward input voltage.

703: Sampling an output voltage to generate a sampled output voltage.

704: Combine the sampled output voltage and the feed-forward input voltage into a stability voltage.

According to the power supply control loop provided in the embodiments of the present invention, an input voltage is sampled to generate a sampled input voltage, anti-steady-state-disturbance processing is performed on the sampled input voltage to generate a feed-forward input voltage, an output voltage is sampled to generate a sampled output voltage, and the sampled output voltage and the feed-forward input voltage that is output by a feed-forward digital control circuit are combined into a stability voltage, thereby alleviating impact of a power source input disturbance on an output voltage.

With descriptions of the foregoing embodiments, a person skilled in the art may clearly understand that the present invention may be implemented by hardware, firmware or a combination thereof. When the present invention is implemented by software, the foregoing functions may be stored in a computer-readable medium or transmitted as one or more instructions or code in the computer-readable medium. The computer-readable medium includes a computer storage medium and a communications medium, where the communications medium includes any medium that enables a computer program to be transmitted from one place to another. The storage medium may be any available medium accessible to a computer. Examples of the computer-readable medium include but are not limited to: a RAM, a read-only memory (ROM), an EEPROM, a CD-ROM (or other optical disk storage, a disk storage medium or other disk storage, or any other medium that can be used to carry or store expected program code in a command or data structure form and can be accessed by a computer. In addition, any connection may be appropriately defined as a computer-readable medium. For example, if software is transmitted from a website, a server or another remote source by using a coaxial cable, an optical fiber/cable, a twisted pair, a Digital Subscriber Line (DSL) or wireless technologies such as infrared ray, radio and microwave, the coaxial cable, optical fiber/cable, twisted pair, DSL or wireless technologies such as infrared ray, radio and microwave are included in fixation of a medium to which they belong. For example, a disk and disc used by the present invention includes a Compact Disc (CD), a laser disc, an optical disc, a Digital Versatile Disc (DVD), a floppy disk and a blue-ray disc, where the disk generally copies data by a magnetic means, and the disc copies data optically by a laser means. The foregoing combination should also be included in the protection scope of the computer-readable medium.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A power supply control loop, comprising:

a feed-forward digital control circuit configured to:

sample an input voltage to generate a sampled input voltage;

perform anti-steady-state-disturbance processing on the sampled input voltage to generate a feed-forward input voltage; and output the feed-forward input voltage; and a feedback digital control circuit coupled to the feed-forward digital control circuit and configured to:

sample an output voltage to generate a sampled output voltage; and combine the sampled output voltage and the feed-forward input voltage that is output by the feed-forward digital control circuit into a stability voltage.

2. The power supply control loop according to claim 1, wherein the feed-forward digital control circuit comprises a sampling module, an anti-steady-state-disturbance processing module, a delay module, and a filtering module, wherein an output end of the sampling module is connected to an input end of the anti-steady-state-disturbance processing module, wherein an output end of the delay module is connected to an input end of the anti-steady-state-disturbance processing module, wherein an output end of the anti-steady-state-disturbance processing module is connected to an input end of the delay module, wherein the output end of the anti-steady-state-disturbance processing module is connected to an input end of the filtering module, wherein the sampling module is configured to:

sample the input voltage; and transmit the sampled input voltage to the anti-steady-state-disturbance processing module, wherein the anti-steady-state-disturbance processing module is configured to:

receive the sampled input voltage transmitted by the sampling module;

receive a previous-moment input voltage transmitted by the delay module;

calculate a difference between the sampled input voltage and the previous-moment input voltage;

use a result of the calculating as a reference voltage;

output the previous-moment input voltage as the feed-forward input voltage when an absolute value of the reference voltage is less than or equal to a first threshold, wherein the first threshold is a positive number;

calculate a sum of the previous-moment input voltage and a preset step rate;

transmit a result of the calculating as the feed-forward input voltage to the delay module and the filtering module when the absolute value of the reference voltage is greater than the first threshold and when the reference voltage is positive; and calculate a difference between the previous-moment input voltage minus the preset step rate;

transmit a result of the calculating as the feed-forward input voltage to the delay module and the filtering module when the absolute value of the reference voltage is greater than the first threshold and when the reference voltage is negative, wherein the delay module is configured to:

receive the feed-forward input voltage transmitted by the anti-steady-state-disturbance processing module;

perform delay processing on the feed-forward input voltage to generate the previous-moment input voltage; and transmit the previous-moment input voltage to the anti-steady-state-disturbance processing module, and wherein the filtering module is configured to:

receive the feed-forward input voltage transmitted by the anti-steady-state-disturbance processing module;

perform filtering processing on the feed-forward input voltage; and output the feed-forward input voltage that is obtained by means of filtering processing.

3. The power supply control loop according to claim 2, wherein the anti-steady-state-disturbance processing module is further configured to:

calculate the sum of the previous-moment input voltage and the preset step rate when the absolute value of the reference voltage is greater than the first threshold and less than a second threshold and when the reference voltage is positive, wherein the second threshold is a positive number;

calculate the difference of the previous-moment input voltage minus the preset step rate when the absolute value of the reference voltage is greater than the first threshold and less than the second threshold and when the reference voltage is negative;

output the result of the calculating as the feed-forward input voltage; and output the sampled input voltage as the feed-forward input voltage when the absolute value of the reference voltage is greater than or equal to the second threshold.

4. The power supply control loop according to claim 3, wherein the anti-steady-state-disturbance processing module comprises a first subtraction circuit, a first comparator, a second comparator, a third comparator, a fourth comparator, a fifth comparator, a sixth comparator, a first AND gate circuit, a second AND gate circuit, a first OR gate circuit, a first controller, a second controller, and a third controller, wherein the sampled input voltage is input to a non-inverting input end of the first subtraction circuit, wherein the previous-moment input voltage is input to an inverting input end of the first subtraction circuit, wherein the first subtraction circuit is configured to calculate the difference of the sampled input voltage minus the previous-moment input voltage, wherein output the difference as the reference voltage, wherein an output end of the first subtraction circuit is separately connected to a non-inverting input end of the first comparator, an inverting input end of the second comparator, an inverting input end of the third comparator, a non-inverting input end of the fourth comparator, a non-inverting input end of a fifth comparator, and an inverting input end of the sixth comparator, wherein the reference voltage is input to the non-inverting input end of the first comparator, wherein the first threshold is input to an inverting input end of the first comparator, wherein an output end of the first comparator is connected to a first input end of the first AND gate circuit, wherein the second threshold is input to a non-inverting input end of the second comparator, wherein the reference voltage is input to the inverting input end of the second comparator, wherein an output end of the second comparator is connected to a second input end of the first AND gate circuit, wherein an output end of the first AND gate circuit is connected to an input end of the first controller, wherein the first controller is configured to:

calculate the sum of the previous-moment input voltage and the preset step rate when the first AND gate circuit outputs a high level; and output the result of the calculating as the feed-forward input voltage, wherein an opposite number of the first threshold is input to a non-inverting input end of the third comparator, wherein the reference voltage is input to the inverting input end of the third comparator, wherein an output end of the third comparator is connected to a first input end of the second AND gate circuit, wherein the reference voltage is input to the non-inverting input end of the fourth comparator, wherein an opposite number of the second threshold is input to the inverting input end of the fourth comparator, wherein an output end of the fourth comparator is connected to a second input end of the second AND gate circuit, wherein an output end of the second AND gate circuit is connected to an input end of the second controller, wherein the second controller is configured to:

calculate the difference of the previous-moment input voltage minus the preset step rate when the second AND gate circuit outputs a high level; and output the result of the calculating as the feed-forward input voltage;

wherein the reference voltage is input to the non-inverting input end of the fifth comparator, wherein the second threshold is input to an inverting input end of the fifth comparator, wherein an output end of the fifth comparator is connected to a first input end of the first OR gate circuit, wherein the opposite number of the second threshold is input to a non-inverting input end of the sixth comparator, wherein the reference voltage is input to the inverting input end of the sixth comparator, wherein an output end of the sixth comparator is connected to a second input end of the first OR gate circuit, wherein an output end of the first OR gate circuit is connected to an input end of the third controller, and wherein the third controller is configured to output the sampled input voltage as the feed-forward input voltage when the first OR gate circuit outputs a high level.

5. The power supply control loop according to claim 3, wherein the anti-steady-state-disturbance processing module comprises a second subtraction circuit, an absolute value circuit, a seventh comparator, an eighth comparator, a ninth comparator, a tenth comparator, a NOT gate circuit, a third AND gate circuit, a fourth AND gate circuit, a fifth AND gate circuit, a fourth controller, a fifth controller, and a sixth controller, wherein the sampled input voltage is input to a non-inverting input end of the second subtraction circuit, wherein the previous-moment input voltage is input to an inverting input end of the second subtraction circuit, wherein the second subtraction circuit is configured to:

calculate the difference of the sampled input voltage minus the previous-moment input voltage; and output the difference as the reference voltage, wherein an output end of the second subtraction circuit is connected to an input end of the absolute value circuit, wherein the absolute value circuit is configured to perform an absolute value operation on the reference voltage to generate the absolute value of the reference voltage, wherein an output end of the absolute value circuit is separately connected to a non-inverting input end of the seventh comparator, an inverting input end of the eighth comparator, and a non-inverting input end of the tenth comparator;

wherein the absolute value of the reference voltage is input to the non-inverting input end of the seventh comparator, wherein the first threshold is input to an inverting input end of the seventh comparator, wherein an output end of the seventh comparator is connected to a first input end of the third AND gate circuit, wherein the second threshold is input to a non-inverting input end of the eighth comparator, wherein the absolute value of the reference voltage is input to the inverting input end of the eighth comparator, wherein an output end of the eighth comparator is connected to a second input end of the third AND gate circuit, wherein an output end of the third AND gate circuit is separately connected to a first input end of the fourth AND gate circuit and a first input end of the fifth AND gate circuit;

wherein the sampled input voltage is input to a non-inverting input end of the ninth comparator, wherein the previous-moment voltage is input to an inverting input end of the ninth comparator, wherein an output end of the ninth comparator is separately connected to a second input end of the fourth AND gate circuit and an input end of the NOT gate circuit;

wherein an output end of the fourth AND gate circuit is connected to an input end of the fourth controller, wherein the fourth controller is configured to:

calculate the sum of the previous-moment input voltage and the preset step rate when the fourth AND gate circuit outputs a high level; and output the result of the calculating as the feed-forward input voltage;

an output end of the NOT gate circuit is connected to a second input end of the fifth AND gate circuit, an output end of the fifth AND gate circuit is connected to an input end of the fifth controller, wherein the fifth controller is configured to:

calculate the difference of the previous-moment input voltage minus the preset step rate when the fifth AND gate circuit outputs a high level; and output the result of the calculating as the feed-forward input voltage, wherein the absolute value of the reference voltage is input to the non-inverting input end of the tenth comparator, wherein the second threshold is input to an inverting input end of the tenth comparator, wherein an output end of the tenth comparator is connected to an input end of the sixth controller, and wherein the sixth controller is configured to output the sampled input voltage as the feed-forward input voltage when the tenth comparator outputs a high level.

6. The power supply control loop according to claim 2, wherein the sampling module comprises a first analog to digital converter configured to:

receive the input voltage;

perform analog-to-digital conversion on the input voltage; and output the sampled input voltage.

7. The power supply control loop according to claim 2, wherein the delay module comprises a delayer configured to:

receive the feed-forward input voltage;

perform delay processing on the feed-forward input voltage; and output the previous-moment input voltage.

8. The power supply control loop according to claim 2, wherein the filtering module comprises a first filter configured to:

receive the feed-forward input voltage output by the anti-steady-state-disturbance processing module;

perform filtering processing on the feed-forward input voltage; and output the feed-forward input voltage that is obtained by means of filtering processing.

9. A digitally controlled power source, wherein the digitally controlled power source comprises a power supply control loop comprising:

a feed-forward digital control circuit configured to:

sample an input voltage to generate a sampled input voltage;

perform anti-steady-state-disturbance processing on the sampled input voltage to generate a feed-forward input voltage; and output the feed-forward input voltage; and a feedback digital control circuit coupled to the feed-forward digital control circuit and configured to:

sample an output voltage to generate a sampled output voltage; and combine the sampled output voltage and the feed-forward input voltage that is output by the feed-forward digital control circuit into a stability voltage.

10. A power supply control method, comprising:

sampling an input voltage to generate a sampled input voltage;

performing anti-steady-state-disturbance processing on the sampled input voltage to generate a feed-forward input voltage;

sampling an output voltage to generate a sampled output voltage; and combining the sampled output voltage and the feed-forward input voltage into a stability voltage.

11. The method according to claim 10, wherein performing anti-steady-state-disturbance processing on the sampled input voltage to generate the feed-forward input voltage comprises:

calculating a difference between the sampled input voltage and a previous-moment input voltage;

using a result of the calculating as a reference voltage;

outputting the previous-moment input voltage as the feed-forward input voltage when an absolute value of the reference voltage is less than or equal to a first threshold;

calculating a sum of the previous-moment input voltage and a preset step rate;

outputting a result of the calculating as the feed-forward input voltage when the absolute value of the reference voltage is greater than the first threshold and when the reference voltage is positive;

calculating a difference of the previous-moment input voltage minus the preset step rate;

outputting a result of the calculating as the feed-forward input voltage when the absolute value of the reference voltage is greater than the first threshold, and the reference voltage is negative;

performing delay processing on the feed-forward input voltage to generate the previous-moment input voltage; and performing filtering processing on the feed-forward input voltage; and outputting the feed-forward input voltage that is obtained by means of filtering processing.

12. The method according to claim 11, wherein calculating the sum of the previous-moment input voltage and the preset step rate and outputting a result of the calculating as the feed-forward input voltage when the absolute value of the reference voltage is greater than the first threshold and when the reference voltage is positive comprises:

calculating the difference of the previous-moment input voltage minus the preset step rate; and outputting the result of the calculating as the feed-forward input voltage when the absolute value of the reference voltage is greater than the first threshold and less than the second threshold and when the reference voltage is negative;

wherein calculating the difference of the previous-moment input voltage minus the preset step rate and outputting a result of the calculating as the feed-forward input voltage when the absolute value of the reference voltage is greater than the first threshold and when the reference voltage is negative comprises:

calculating the difference of the previous-moment input voltage minus the preset step rate; and outputting the result of the calculating as the feed-forward input voltage when the absolute value of the reference voltage is greater than the first threshold and less than the second threshold and when the reference voltage is negative, and wherein the method further comprises outputting the sampled input voltage as the feed-forward input voltage when the absolute value of the reference voltage is greater than or equal to the second threshold.

* * * * *